US006106581A

United States Patent [19]

Garing et al.

[11] Patent Number: 6,106,581

[45] Date of Patent: Aug. 22, 2000

[54] OZONE STABILITY OF DYED AND UNDYED POLYAMIDE-CONTAINING MATERIAL

[75] Inventors: Serge Charles Jacques Garing, Rhode Saint Genése, Belgium; Martin Jöllenbeck, Müllheim; Claudius Brinkmann, Lörrach, both of Germany

[73] Assignee: Ciba Specialty Chemicals Corporation, Tarrytown, N.Y.

[21] Appl. No.: 09/320,918

[22] Filed: May 27, 1999

[30] Foreign Application Priority Data

Jun. 2, 1998 [EP] European Pat. Off. ..... 98810506

[51] Int. Cl.[7] ..... D06M 13/238; D06P 1/651

[52] U.S. Cl. ..... 8/595; 8/115.56

[58] Field of Search ..... 8/595, 115.56

[56] References Cited

U.S. PATENT DOCUMENTS

| | | | |
|---|---|---|---|
| 2,317,728 | 4/1943 | Bristol | 117/139 |
| 2,808,346 | 10/1957 | Lutgerhorst | 117/118 |
| 3,961,881 | 6/1976 | Sumner et al. | 8/17 |
| 4,304,568 | 12/1981 | Johnson et al. | 8/568 |

FOREIGN PATENT DOCUMENTS

| | | |
|---|---|---|
| 1126354 | 3/1962 | Germany . |
| 61-194280 | 2/1985 | Japan . |
| 1 464 866 | 2/1977 | United Kingdom . |

OTHER PUBLICATIONS

Derwent Abstr. 77–50869Y of JP52066720 Jun. 1977.
Derwent Abstr. 96–271655 of JP8112376A May 1996.
Derwent Abstr. 81–46900D of JP56053291 A May 1981.
Derwent Abstr. 92–044607 of JP3287873 Dec. 1991.

*Primary Examiner*—Margaret Einsmann
*Attorney, Agent, or Firm*—Kevin T. Mansfield

[57] ABSTRACT

This invention relates to the use of tannin for improving the ozone fastness of dyed and undyed polyamide-containing material, which comprises applying tannin to, or incorporating it into, the polyamide-containing material.

6 Claims, No Drawings

OZONE STABILITY OF DYED AND UNDYED POLYAMIDE-CONTAINING MATERIAL

The present invention relates to the use of tannin for improving the ozone fastness property of dyed and undyed polyamide-containing material.

As is commonly known, dyed and undyed polyamide-containing material, such as polyamide-containing fibre material, is susceptible to environmental influences, for example to the action of light, heat or ozone, and usually must be stabilised against them. However, the stabilisers used to date do not fully meet present requirements. There is therefore still a demand for agents ensuring that the polyamide-containing material is stabilised in accordance with today's requirements, especially against ozone.

Surprisingly, it has been found that when using tannin according to this invention the polyamide-containing material is very well stabilised against ozone.

Accordingly, this invention relates to the use of tannin for improving the ozone fastness properties of dyed and undyed polyamide-containing material, which comprises applying tannin to, or incorporating it into, the polyamide-containing material.

Throughout this application, the term "tannin" will be understood as referring to a class of the natural polyphenols of a very wide range of composition which are structurally derived from 3,4,5trihydroxybenzoic acid (so-called gallic acid). These are, for example, the compounds of formula (so-called gallotannins)

(1)

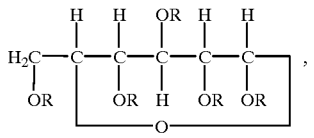

wherein

R is independently of one another a radical of formula (2)

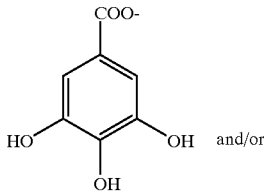

(3)

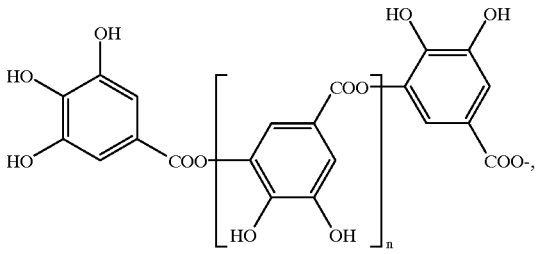

wherein n is a number 0, 1 or 2.

The tannins as natural substances are usually obtained in the form of mixtures. All commercially available tannins can be employed for the use according to this invention, advantageously those having a molecular weight from 900 to 3500.

When treating polyamide-containing material, tannin is preferably used in the form of an aqueous stock solution. The tannin content in this solution can vary within a wide range and is preferably from 10 to 50% by weight, more preferably from 15 to 40% by weight, most preferably from 20 to 35% by weight, based on the total weight of the solution.

In addition to tannin and water, the aqueous solution can also contain further assistants, for example small amounts of an aliphatic organic acid, such as acetic acid, for preventing oxidation.

The aqueous tannin solution can furthermore also contain, for example, wetting agents, such as isopropanol, and complex formers, such as potassium-antimonium-tartrate or aluminium-potassium-sulfate, as well as other additives customarily used in the textile finishing industry.

The tannin can be applied to the polyamide-containing material by any of the processes customarily used in the textile finishing industry, for example by a continuous or discontinuous process, or by a printing process, for example by jet, rotary or flat screen printing. In the discontinuous process (exhaust process) the liquor ratio can be chosen from a wide range, for example from 1:4 to 1:100, preferably from 1:6 to 1:50.

In the continuous process, the liquor is applied to the polyamide-containing material e.g. by padding or slop-padding.

Tannin, or the aqueous tannin solution, can in this case be applied to the polyamide-containing material to be treated in any treatment step, for example from a pre- or aftertreatment liquor, or before, during or after the dyeing process from the dye bath.

It is also possible to add tannin to the polyamide-containing material as additive before the extrusion of the spinning paste.

The tannin is used in an amount from 0.5 to 10% by weight, preferably from 2 to 6% by weight, more preferably from 3 to 4% by weight, based on the total weight of the polyamide-containing material to be treated.

Tannin can be applied to the polyamide-containing material within a wide pH range, preferably at pH values from 2 to 8, particularly preferably from 5 to 6.

If tannin is applied to the polyamide-containing material before, during or after a dyeing process from a dye bath, then this is done at the standard dyeing temperatures.

From an aftertreatment liquor, tannin is usually applied to the dyed polyamide-containing material at a temperature in the range from 50 to 100° C., preferably from 60 to 90° C.

Polyamide-containing material to be treated according to the inventive use is mainly polyamide-containing fibre material. The polyamide-containing fibre material can in this case consist entirely of polyamide, e.g. of polyamide 6, polyamide 6.6, polyamide 12 or of modified polyamide, for example basic dyeable polyamide, or of mixtures of differently modified polyamide types, or can be blended fabrics with e.g. polyester, polypropylene, polyurethane, polyacryl or wool.

The polyamide-containing fibre material can be in a very wide range of forms of presentation, for example in the form of fibres, taffeta, wovens, knits, bonded fabrics and, preferably, yarn and carpet.

The novel process is preferably used on dyed polyamide fibre material, more preferably on polyamide fibre material dyed with at least one blue dye, preferably on polyamide fibre material dyed with at least one anthraquinone dye, it being possible to apply the tannin before, during or after dyeing. Suitable anthraquinone dyes are, for example, the anthraquinone dyes known from Colour Index Third Edition, in particular those listed e.g. under C.I. Acid Blue, for example those having the C.I. Constitution Number: 58800, 61125, 62055, 61530, 61560, 62125, 62130, 63000, 63010, 62085, 62095, 62145, 62135, 63315, 62005, 62045, 63330,61585,64515, 62110, 6215564005,61135,62075, 62070,61130.

Also suitable for use according to this invention is the polyamide-containing material in the form of a spinning paste. In this case tannin is advantageously added in pure, powdered form to the spinning paste before extrusion. For the present, the ranges and preferences indicated above apply to the amounts of tannin used.

The novel process is carried out, for example, by applying tannin from a dyeing liquor to the polyamide-containing fibre material and then fixing it by heat treatment. Dyes to be used can be all dyes suitable for dyeing polyamide, for example acid or metal complex dyes, such as 1:2-chromium, 1:2-cobalt and copper complex dyes, or disperse or reactive dyes.

Examples of such dyes are described in Colour Index, 3$^{rd}$ edition, Vol. 4.

The polyamide-containing material treated with tannin according to this invention has good allround fastness properties, such as good fastness to wetting and excellent fastness to chlorine, and it is particularly distinguished by high stability to heat and ozone.

The following Examples illustrate the invention in more detail. Unless otherwise stated, parts and percentages are by weight. Temperatures are given in degrees Celsius. The relationship between parts by weight and parts by volume is the same as that between the gramme and the cubic centimeter.

EXAMPLE 1

(Yarn dyeing)

A polyamide 6 yarn is treated for 10 to 15 minutes at 20 to 25° C. in a skein dyeing apparatus with an aqueous liquor containing 2 g/l of ammonium acetate, 1 g/l of a commercially available levelling agent (®Univadin NT new) and 0.5 g/l of a commercially available deaerator (®Albegal FFD), which liquor is adjusted to pH 6.0 with acetic acid. Subsequently, 0.077 g/l of the dye of formula (4)

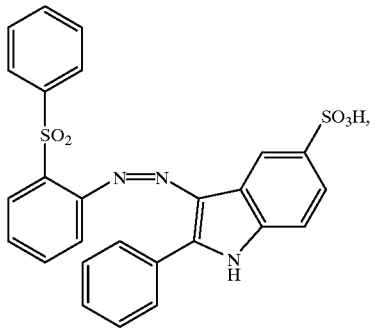

0.03 g/l of the dye of formula (5)

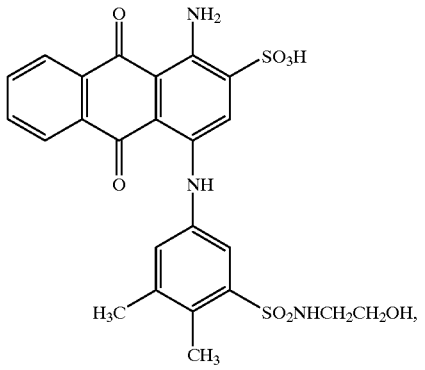

0.01 g/l of the dye of formula (6)

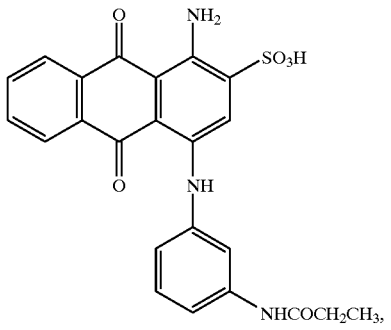

and 0.045 g/l of the dye of formula (7)

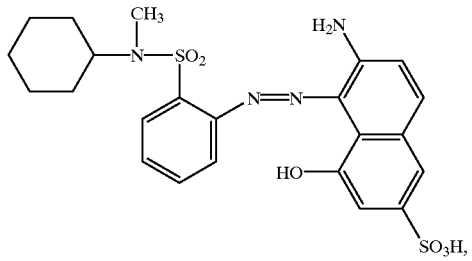

are added to the liquor and the skein is treated for another 10 minutes at 20 to 25° C. The temperature is then raised to boiling point and the skein is dyed at this temperature for 45 to 60 minutes. The dyeing liquor is then slowly cooled to 80° C. and the dyed skein is rinsed with water.

Subsequently, the dyed skein is aftertreated for 20 minutes at 70° C. with a fresh liquor containing 6 g/l of a 30% aqueous solution of tannin, which liquor is adjusted to a pH from 4 to 6 with acetic acid, rinsed with water and dried.

This gives a brown polyamide 6 yarn having very good stability to heat and ozone and fastness to chlorine.

EXAMPLE 2

(Exhaust process)

A polyamide 6 carpet is treated for 10 to 15 minutes at 20 to 25° C. in a winch beck with an aqueous liquor containing 2 g/l of ammonium acetate, 2 g/l of a commercially available levelling agent (®Univadin NT new), and 0.5 g/l of a commercially available deaerator (®Albegal FFD), which liquor is adjusted to pH 6.0 with acetic acid.

Subsequently, 0.230 g/l of the dye of formula (4), 0.156 g/l of the dye of formula (5), 0.052 g/l of the dye of formula (6) and 0.125 g/l of the dye of formula (7)

are added to the liquor and the carpet is treated for another 10 minutes at 20 to 25° C. The temperature is then raised to boiling point and the carpet is dyed at temperature for 45 to 60 minutes. The dye liquor is then slowly cooled to 80° C. and the dyed carpet is rinsed with water.

Subsequently, the dyed carpet is aftertreated for 20 minutes at 60 to 90° C. with a fresh liquor containing 3 g/l of a 30% aqueous solution of tannin, which liquor is adjusted to a pH from 4 to 6 with acetic acid, rinsed with water and dried.

This gives a grey polyamide 6 carpet having very good stability to heat and ozone and fastness to chlorine.

EXAMPLE 3

(Carpet and yarn printing, space dyeing)

A carpet manufactured from polyamide yarn is padded with an aqueous liquor containing 1.6 g/l of the dye of formula (4), 3.3 g/l of the dye of formula (5), 1.2 g/l of the dye of formula (7)

1 g/l of a commercially available thickener (®Solvitose OFA), 2 g/l of a commercially available antifrosting assistant (®Irgapadol PN), 2 g/l of a commercially available wetting agent (Tinovetin JUN), and 30 g/l of a 30% aqueous solution of tannin, (liquor uptake about 100%), the pH of the liquor being adjusted to 6 with acetic acid.

Subsequently, the dyed carpet is printed by means of a printing roll with a printing paste containing per 1 kg of printing paste 1 g of the dye of formula (8)

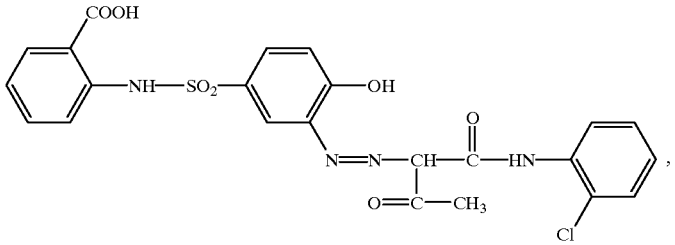

1:2 Co-complex 8 g of a commercially available thickener (®Solvitose OFA), 2 g of a commercially available antifrosting assistant (®Irgapadol PN), and 10 g of a 30% aqueous solution of tannin, which liquor is adjusted to pH 5 with acetic acid, and then by means of a second printing roll with a printing paste containing per 1 kg of printing paste 1 g of a dye mixture containing the dyes of formulae (9)

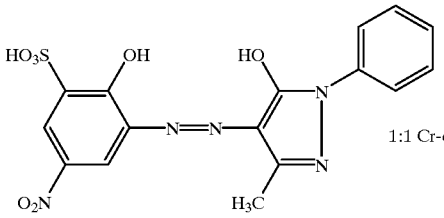

1:1 Cr-complex and

-continued (10)

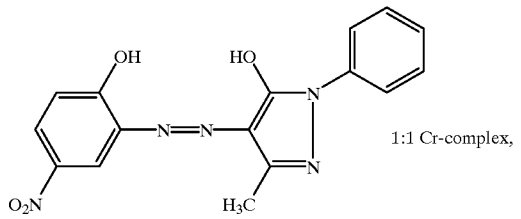

8 g of a commercially available thickener (®Solvitose OFA), 2 g of a commercially available antifrosting assistant (®Irgapadol PN), and 10 g of a 30% aqueous solution of tannin, which liquor is adjusted to pH 5 with acetic acid.

The dyed and printed carpet is steamed for 5 minutes at 100° C., washed, rinsed and dried. This gives a dark grey carpet with yellow and red stripes which has excellent stability to heat and ozone and fastness to chlorine.

EXAMPLE 4

(Jet printing)

A carpet manufactured from polyamide 6.6 is printed on a jet printing apparatus (chromojet or millitron) with a printing paste containing per 1 kg of the printing paste 2 g of the dye of formula (8), 1 g of a commercially available antifrosting assistant (®Irgapadol PN), 0.5 g of a commercially available antifoam (®Fumexol AS) and 10 g of a 30% aqueous solution of tannin, which, by adding a thickener suitable for jet printing, is adjusted to a viscosity of 300 cps and, by adding acetic acid, to pH 4.0.

The carpet is then treated for 10 minutes with saturated steam at 100° C. and is then rinsed and dried.

This gives a carpet printed yellow which has excellent stability to heat and ozone and fastness to chlorine.

EXAMPLE 5

(Continuous process)

A carpet manufactured from polyamide 6 is poured over with an aqueous liquor containing 0.230 g/l of the dye of formula (4), 0.156 g/l of the dye of formula (5), 0.052 g/l of the dye of formula (6), 0.125 g/l of the dye of formula (7), 1 g/l of a commercially available thickener (®Solvitose OFA), 2 g/l of a commercially available antifrosting assistant (®Irgapadol PN), 2 g/l of a commercially available wetting agent (®Tinovetin JUN), and 10 g/l of a 30% aqueous solution of tannin, which liquor is adjusted to pH 6.0 with an ammonium acetate/acetic acid buffer (liquor up-take about 450%).

Subsequently, the dyed carpet is steamed for 5 minutes at 100° C., rinsed with water and dried.

This gives a grey carpet which has excellent stability to heat and ozone and fastness to chlorine.

EXAMPLE 6

(Continuous process differential dyeing)

A carpet manufactured from polyamide 6 is poured over with an aqueous liquor containing 0.077 g/l of the dye of formula (4), 0.03 g/l of the dye of formula (5), 0.01 g/l of the dye of formula (6), 0.045 g/l of the dye of formula (7), 0.183 g/l of the dye of formula (11)

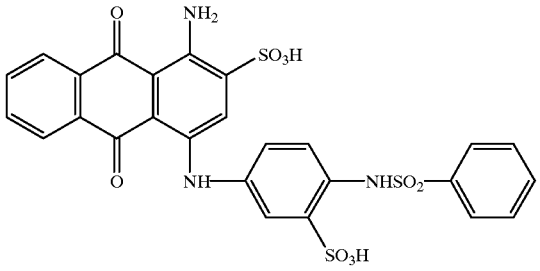

0.009 g/l of the dye of formula (12)

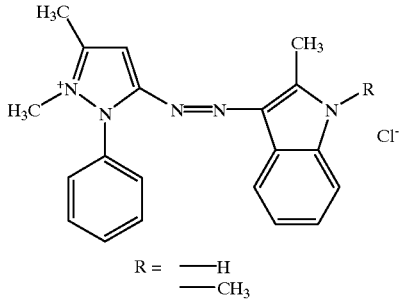

0.004 g/l of the dye of formula (13)

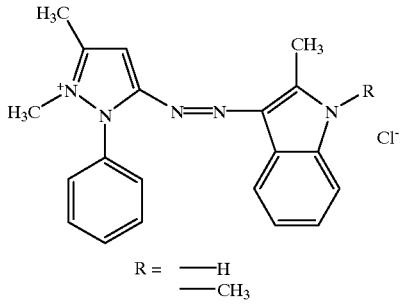

, 0.016 g/l of the dye of formula (14)

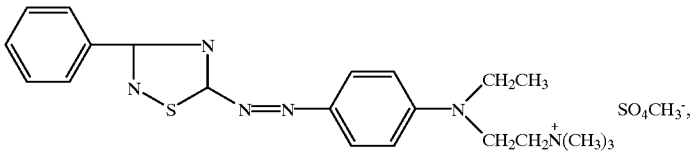

and 0.003 g/l of the dye of formula (15)

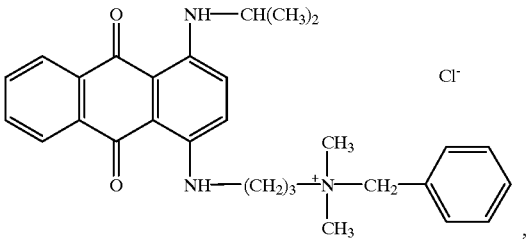

1 g/l of a commercially available thickener (®Solvitose OFA), 2 g/l of a commercially available antifrosting assistant (®Irgapadol PN), 2 g/l of a commercially available wetting agent (®Tinovetin JUN), 2 g/l of a commercially available levelling and dispersing agent (®Albegal W) and 10 gl of a 30% aqueous solution of tannin, which liquor is adjusted to pH 6 with an ammonium acetate/acetic acid buffer (liquor uptake about 450%). Subsequently, the dyed carpet is steamed for 5 minutes at 100° C., rinsed with water and dried.

This gives a grey-orange carpet which has excellent stability to heat and ozone and fastness to chlorine.

What is claimed is:

1. Method of improving the ozone fastness properties of dyed and undyed polyamide-containing material, which comprises applying tannin to the polyamide-containing material, whereby the ozone fastness properties of the polyamide-containing material is improved and wherein the polyamide-containing material is a polyamide/polyester, polyamide/polypropylene, polyamide/polyacrylic, polyamide/polyurethane or a synthetic polyamide/wool fiber blend.

2. Method according to claim 1, which comprises using from 0.5 to 10% by weight of tannin, based on the total weight of the polyamide-containing material to be treated.

3. Method according to claim 1, which comprises applying tannin before, during or after a dyeing process from a dye bath to the polyamide-containing material.

4. Method of improving the ozone fastness properties of dyed and undyed polyamide-containing carpet material, which comprises applying tannin to a polyamide-containing material in the form of a carpet, whereby the ozone fastness properties of the polyamide-containing carpet material is improved.

5. Method according to claim 4, which comprises applying from 0.5 to 10% by weight of tannin, based on the total weight of the polyamide-containing carpet material to be treated.

6. Method according to claim 4, which comprises applying tannin before, during or after a dyeing process from a dye bath to the polyamide-containing carpet material.

* * * * *